US012716416B2

(12) United States Patent
Oh et al.

(10) Patent No.: US 12,716,416 B2
(45) Date of Patent: Aug. 25, 2026

(54) LIQUID SUPPLY DEVICE WITH FUNCTION OF REDUCING GENERATION OF PARTICLES

(71) Applicant: Samsung Electronics Co., Ltd., Suwon-si (KR)

(72) Inventors: Kyoungwhan Oh, Suwon-si (KR); Hokyun Kim, Suwon-si (KR); Kyung-Won Kang, Suwon-si (KR); Takashi Sasa, Suwon-si (KR); Sanghyun Lim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 19/009,048

(22) Filed: Jan. 3, 2025

(65) Prior Publication Data

US 2026/0117779 A1 Apr. 30, 2026

(30) Foreign Application Priority Data

Apr. 1, 2024 (KR) ..... 10-2024-0044320

(51) Int. Cl.

| | |
|---|---|
| ***F04D 13/06*** | (2006.01) |
| ***F04D 13/02*** | (2006.01) |
| ***F04D 15/00*** | (2006.01) |
| ***F04D 15/02*** | (2006.01) |
| ***F04D 29/048*** | (2006.01) |

(Continued)

(52) U.S. Cl.

CPC ..... *F04D 13/06* (2013.01); *F04D 13/024* (2013.01); *F04D 13/027* (2013.01); *F04D 13/0606* (2013.01); *F04D 13/0633* (2013.01); *F04D 13/064* (2013.01); *F04D 13/0666* (2013.01); *F04D 29/048* (2013.01);

(Continued)

(58) Field of Classification Search

CPC .... F04D 29/048; F04D 13/0666; F04D 13/06; F04D 13/064; F04D 29/426; F04D 13/0606; F04D 13/0633; F04D 13/024; F04D 29/186; F04D 13/027

See application file for complete search history.

(56) References Cited

U.S. PATENT DOCUMENTS

| | | | |
|---|---|---|---|
| 6,589,030 | B2 | 7/2003 | Ozaki |
| 7,128,538 | B2 | 10/2006 | Tsubouchi et al. |

(Continued)

FOREIGN PATENT DOCUMENTS

| | | | |
|---|---|---|---|
| JP | 2016188617 | A | 11/2016 |
| JP | 2023125645 | A | 9/2023 |

(Continued)

*Primary Examiner* — Peter J Bertheaud

(74) *Attorney, Agent, or Firm* — Wolf, Greenfield & Sacks, P.C.

(57) ABSTRACT

A liquid supply device that reduces particle generation includes a pump configured to supply a liquid to a nozzle within a wafer processing chamber, a controller configured to control the pump, and a main power source configured to supply electrical power to the pump. The pump includes a stator, a coil surrounding the stator, a case having an internal space, and an impeller within the case internal space. The impeller is rotated by a magnetic force generated by the stator and the coil. When the electrical power is shut off from the main power source to the coil, the controller is configured to reduce a rotational speed of the impeller and stop the pump.

17 Claims, 9 Drawing Sheets

(51) Int. Cl.
*F04D 29/18* (2006.01)
*F04D 29/42* (2006.01)

(52) U.S. Cl.
CPC ..... *F04D 29/186* (2013.01); *F04D 29/426* (2013.01); *F04D 15/0066* (2013.01); *F04D 15/0245* (2013.01)

(56) References Cited

U.S. PATENT DOCUMENTS

| | | | | |
|---|---|---|---|---|
| 10,995,765 | B2 | 5/2021 | Sato et al. | |
| 11,619,236 | B2 * | 4/2023 | Schöb | F04D 13/064 417/53 |
| 2001/0053330 | A1 | 12/2001 | Ozaki | |
| 2005/0008496 | A1 | 1/2005 | Tsubouchi et al. | |
| 2016/0131141 | A1 | 5/2016 | Sato et al. | |
| 2021/0079922 | A1 | 3/2021 | Schmid et al. | |
| 2022/0310416 | A1 | 9/2022 | Aoki et al. | |

FOREIGN PATENT DOCUMENTS

| | | | |
|---|---|---|---|
| KR | 102393559 | B1 | 5/2022 |
| KR | 20220132421 | A | 9/2022 |

* cited by examiner

LIQUID SUPPLY DEVICE WITH FUNCTION OF REDUCING GENERATION OF PARTICLES

CROSS-REFERENCE TO RELATED APPLICATION

This application claims the benefit of Korean Patent Application No. 10-2024-0044320, filed on Apr. 1, 2024, in the Korean Intellectual Property Office, the disclosure of which is incorporated herein by reference in its entirety.

BACKGROUND

1. Field of the Invention

One or more embodiments relate to a liquid supply device with a function of reducing a generation of particles.

2. Description of the Related Art

A semiconductor includes invisible nanoscale fine circuit patterns. To implement a fine pattern, boundaries associated with a portion that needs to be cut and a portion that needs to be maintained may need to be clearly specified. Such a process is called photolithography in a semiconductor process. Lithography refers to a method of printing a drawing by engraving the drawing on a stone plate. Since the drawing is printed, the same shape may be repeatedly engraved. In the semiconductor process, the same shape needs to be printed without a few tens of nanoscale errors. A photo is obtained by implementing a lithographic scheme using light. A drawing is engraved on a plate called a mask and exposed to light, and only areas through which the light passes are collected in one place through an optical lens and printed on a wafer in a small pattern. Due to a photoresist applied onto the wafer, a chemical action occurs only in a portion exposed to light. A portion exposed to light and a portion that is not exposed to light differ from each other in solubility. Subsequently, through development, only a desired pattern area may be cut in an etch process, or an implant may be implanted into only a desired area in an implant process.

A photolithography process includes a coater, a developer, and the like. In the coater and the developer, liquid spraying is performed. To prevent impurities from being unintentionally placed on a wafer, liquid is required to be highly clean. In a pump that sprays liquid, technology to reduce the generation of particles is being developed.

The above information is presented as background information only to assist with an understanding of the disclosure. No determination has been made, and no assertion is made, as to whether any of the above might be applicable as a prior art with regard to the disclosure.

SUMMARY

According to an aspect, there is provided a liquid supply device that reduces particle generation. The liquid supply device includes a pump configured to supply a liquid to a nozzle within a wafer processing chamber, a controller configured to control the pump, and a main power source configured to supply electrical power to the pump. The pump includes a stator, a coil surrounding the stator, a case having an internal space, and an impeller within the case internal space, wherein the impeller is rotated by a magnetic force generated by the stator and the coil. When the electrical power is shut off from the main power source to the coil, the controller is configured to reduce a rotational speed of the impeller and stop the pump.

In an embodiment, the pump is a magnetic levitation-type pump configured to rotate the impeller in a non-contact manner by the magnetic force.

In an embodiment, at least a portion of the impeller may contact the case when the impeller is at rest.

In an embodiment, the impeller may include an impeller body, a permanent magnet inside the impeller body, and an impeller arm that protrudes from the impeller body in a direction perpendicular to a rotation axis of the impeller body and that contacts the case when the impeller is at rest.

In an embodiment, the liquid supply device may further include an auxiliary power source configured to supply auxiliary electrical power to the pump.

In an embodiment, when the electrical power from the main power source is shut off, the controller is configured to control the pump using the auxiliary electrical power from the auxiliary power source.

In an embodiment, a magnitude of a voltage of the auxiliary electrical power from the auxiliary power source to the pump may be less than a magnitude of a voltage of the electrical power from the main power source to the pump.

In an embodiment, when the auxiliary electrical power is supplied from the auxiliary power source to the pump, the rotational speed of the impeller may decrease.

In an embodiment, the liquid supply device may further include a first power source line connected to the main power source, a second power source line extending from the first power source line, a pair of first switches connected to the second power source line, a third power source line extending from the first power source line, a pair of second switches connected to the third power source line, and a fourth power source line configured to connect the second power source line and the third power source line. One end of the fourth power source line is between the pair of first switches, an opposite end of the fourth power source line is between the pair of second switches, and the fourth power source line is connected to the pump. The controller is configured to control on and off of the pair of first switches and the pair of second switches.

In an embodiment, the auxiliary power source may be connected to the first power source line.

In an embodiment, the auxiliary power source may include at least one capacitor.

In an embodiment, the auxiliary power source may include a plurality of capacitors connected in parallel to the first power source line.

In an embodiment, the liquid supply device may further include an interface configured to provide operational control of the controller to a user.

In an embodiment, the interface may include a screen that is configured to display a graphical user interface (GUI) associated with a software program. When the software program GUI displayed within the screen is closed, the controller is configured to selectively reduce the rotational speed of the impeller.

In an embodiment, when the software program GUI is closed, the electrical power supplied from the main power source to the pump may decrease.

According to another aspect, there is provided a liquid supply device that reduces particle generation and includes a pump configured to supply a liquid to a nozzle within a wafer processing chamber, a controller configured to control the pump, a main power source configured to supply electrical power to the pump, and an auxiliary power source configured to supply auxiliary electrical power to the pump.

The auxiliary power source is spaced apart from the main power source. The pump includes a stator, a coil surrounding the stator, a case having an internal space, and an impeller within the case internal space, wherein the impeller is rotated by a magnetic force generated by the stator and the coil. When the electrical power is shut off from the main power source to the coil, the controller is configured to control the auxiliary power source to supply the auxiliary electrical power to the pump to reduce a rotational speed of the impeller and stop the pump.

In an embodiment, a magnitude of a voltage of the auxiliary electrical power supplied by the auxiliary power source to the pump may be less than a magnitude of a voltage of the electrical power supplied by the main power source to the pump.

In an embodiment, the liquid supply device may further include a first power source line connected to the main power source and the auxiliary power source, a second power source line extending from the first power source line, a pair of first switches connected to the second power source line, a third power source line extending from the first power source line, a pair of second switches connected to the third power source line, and a fourth power source line configured to connect the second power source line and the third power source line. One end of the fourth power source line is between the pair of first switches, an opposite end of the fourth power source line is between the pair of second switches, and the fourth power source line is connected to the pump. The controller is configured to control on and off of the pair of first switches and the pair of second switches.

According to another aspect, there is provided a liquid supply device that reduces particle generation and includes a pump configured to supply a liquid to a nozzle within a wafer processing chamber, a controller configured to control the pump, a main power source configured to supply electrical power to the pump, and an interface configured to provide operational control of the controller to a user. The pump includes a stator, a coil surrounding the stator, a case having an internal space, and an impeller within the case internal space. The impeller is rotated by a magnetic force generated by the stator and the coil. When the electrical power is shut off from the main power source to the coil, the controller is configured to reduce a rotational speed of the impeller and stop the pump.

In an embodiment, the interface may include a screen that is configured to display a graphical user interface (GUI) associated with a software program that is configured to control operations of the liquid supply device. When the software program GUI displayed within the screen is closed, the controller may selectively reduce the rotational speed of the impeller.

Additional aspects of embodiments will be set forth in part in the description which follows and, in part, will be apparent from the description, or may be learned by practice of the disclosure.

Effects of the liquid supply device with the function of reducing the generation of the particles according to various embodiments are not limited to those described above effects, and other effects not mentioned herein will be clearly understood by one of ordinary skill in the art to which the disclosure belongs, from the following description.

BRIEF DESCRIPTION OF THE DRAWINGS

These and/or other aspects, features, and advantages of the invention will become apparent and more readily appreciated from the following description of embodiments, taken in conjunction with the accompanying drawings of which.

DETAILED DESCRIPTION

Figure 1:
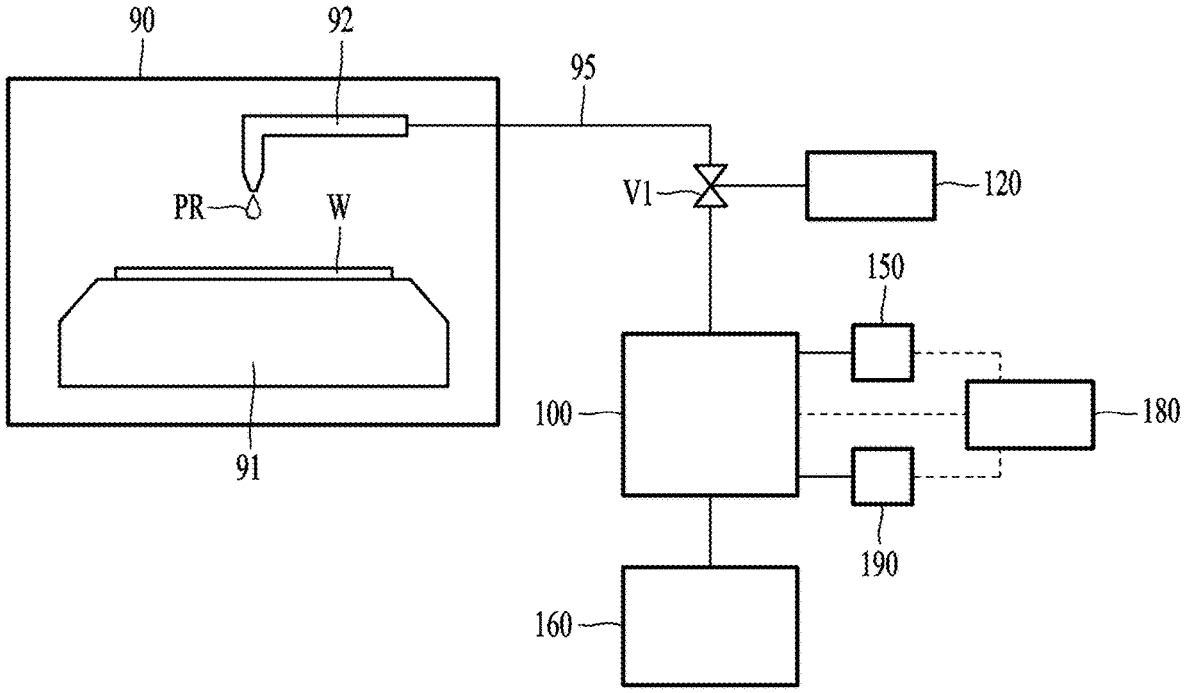
FIG. 1 is a diagram illustrating a liquid supply system according to an embodiment.

Hereinafter, embodiments will be described in detail with reference to the accompanying drawings. When describing the embodiments with reference to the accompanying drawings, like reference numerals refer to like components and a repeated description related thereto will be omitted.

FIG. 1 is a diagram illustrating a liquid supply system according to an embodiment.

Referring to FIG. 1, a liquid supply device may provide a liquid PR to a nozzle 92 installed in a chamber 90. For example, the liquid PR may be a photoresist. A wafer W may be loaded on a stage 91 disposed inside the chamber 90. The liquid PR provided to the nozzle 92 may be provided on the wafer W loaded on the stage 91. A photoresist pattern may be formed on the wafer W using the liquid PR.

A first pipe 95 may connect a pump 100 and the nozzle 92. The liquid PR may be provided from the pump 100 to the nozzle 92 via the first pipe 95. A first valve V1 may be installed in the first pipe 95. The first valve V1 may adjust an amount of the liquid PR to flow into the first pipe 95.

A valve controller 120 may control the first valve V1 to adjust the amount of the liquid PR to flow into the first pipe 95. The valve controller 120 may control an internal pressure of the first pipe 95 by adjusting the amount of the liquid PR to flow into the first pipe 95 based on a vertical position of the nozzle 92.

The liquid supply device may supply a liquid from a source 160 into the chamber 90. The liquid supply device may include the pump 100, a main controller 180, a main power source 150, and an auxiliary power source 190.

One side of the pump 100 may be connected to the source 160 and another side thereof may be connected to the first pipe 95. The source 160 may store a liquid. The pump 100 may be a pump operating in a magnetic levitation manner. The pump 100 may be connected to the main power source 150 and the auxiliary power source 190. The main power source 150 may supply a power to the pump 100. The auxiliary power source 190 may, in special circumstances, supply a power to the pump 100. For example, when the main power source 150 is shut down, the auxiliary power source 190 may supply the power to the pump 100.

The main controller 180 may control the pump 100, the main power source 150, and the auxiliary power source 190. For example, the main controller 180 may control the pump 100 to control a rotational speed of the pump 100. The rotational speed of the pump 100 may be a rotational speed of an impeller. The main controller 180 may control an amount of power to be supplied to the pump 100. The main controller 180 may control the rotational speed of the pump 100 by controlling a switch of the pump 100. In the present disclosure, a main controller may also be referred to as a "controller."

The controller 180 may reduce a generation of particles in the pump 100. For example, when the main power source 150 is shut down, the controller 180 may slowly reduce the rotational speed of the pump 100 by controlling the pump 100 using the auxiliary power source 190. When a power supply of the main power source 150 is blocked, the controller 180 may control the pump 100 using the power of the auxiliary power source 190. Since the rotational speed of the pump 100 is not rapidly reduced based on the above scheme, a collision between components in the pump 100 may be reduced, and the generation of the particles may be reduced.

Figure 2:
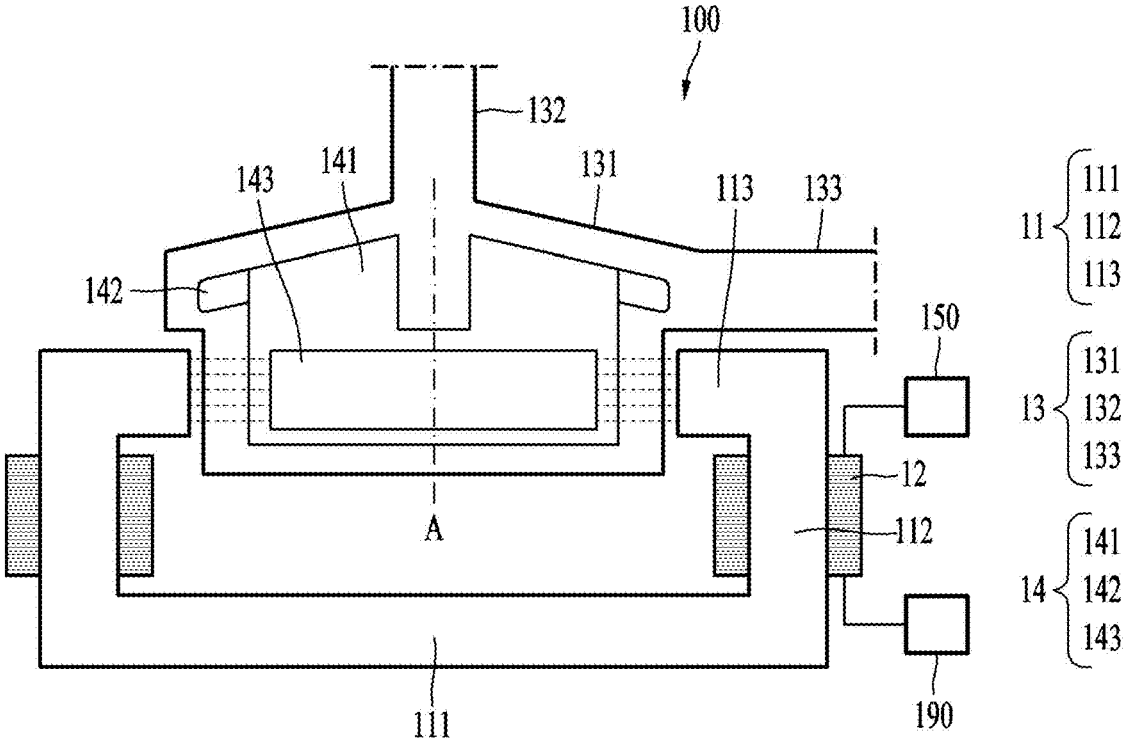
FIG. 2 is a diagram schematically illustrating a portion of a liquid supply device according to an embodiment.

FIG. 2 is a diagram schematically illustrating a portion of a liquid supply device according to an embodiment.

Referring to FIG. 2, the pump 100 is a magnetic levitation-type pump. The pump 100 may receive a liquid in a first direction and discharge the liquid in a second direction. The pump 100 may supply a liquid to a target position. For example, the pump 100 may supply a liquid into a chamber. The liquid may be, for example, a photoresist. The pump 100 may include a stator 11, a coil 12, a case 13, and an impeller 14.

The stator 11 may support the coil 12. The stator 11 may include a stator base 111, a stator body 112 formed to protrude upward from the stator base 111, and a stator head 113 formed to protrude in a direction from an end portion of the stator body 112 toward the case 13. One surface of the stator head 113 may face the case 13.

The coil 12 may be wound around the stator 11. The coil 12 may generate a magnetic field that interacts with impeller 14. The coil 12 may be wound around the stator body 112. Current may flow in the coil 12. Current may flow in the coil 12 in the first direction or the second direction.

The case 13 may accommodate the impeller 14. The case 13 may include a case body 131 including an internal space to accommodate the impeller 14, an inlet 132 formed in the case body 131 and opened in the first direction, and an outlet 133 formed in the case body 131 and provided at a position spaced apart from the inlet 132. A liquid may flow into the case body 131 through the inlet 132. The liquid may be discharged from the case body 131 through the outlet 133.

The impeller 14 may be rotated due to an influence by the magnetic field generated by the coil 12. The impeller 14 may be rotated in a state of being magnetically levitated. The impeller 14 may be rotated without contacting the case 13. When the impeller 14 is suddenly and unintentionally stopped, at least a portion of the impeller 14 may contact the case 13. For example, when the power supply of the main power source 150 is blocked (i.e., shut off or otherwise unavailable), at least a portion of the impeller 14 may contact the case 13. However, according to an embodiment, when the power supply of the main power source 150 is blocked, the liquid supply device may allow the impeller 14 to be slowly decelerated by supplying a power to the coil 12 using the auxiliary power source 190. When the impeller 14 is slowly decelerated, an amount of impact applied to the impeller 14 and the case 13 may decrease. When the amount of impact applied to the impeller 14 and the case 13 decreases, a generation of particles may be reduced.

The impeller 14 may be accommodated inside the case 13. The impeller 14 may include an impeller body 141 provided to be rotatable about a rotation axis A, an impeller arm 142 formed to protrude from the impeller body 141, and a permanent magnet 143 accommodated inside the impeller body 141. The impeller arm 142 may generate a flow in the case 13. The impeller arm 142 may be formed to protrude from the impeller body 141 in a direction perpendicular to the rotation axis A of the impeller body 141. When the impeller 14 is at rest, the impeller arm 142 may contact the case 13.

Figure 3:
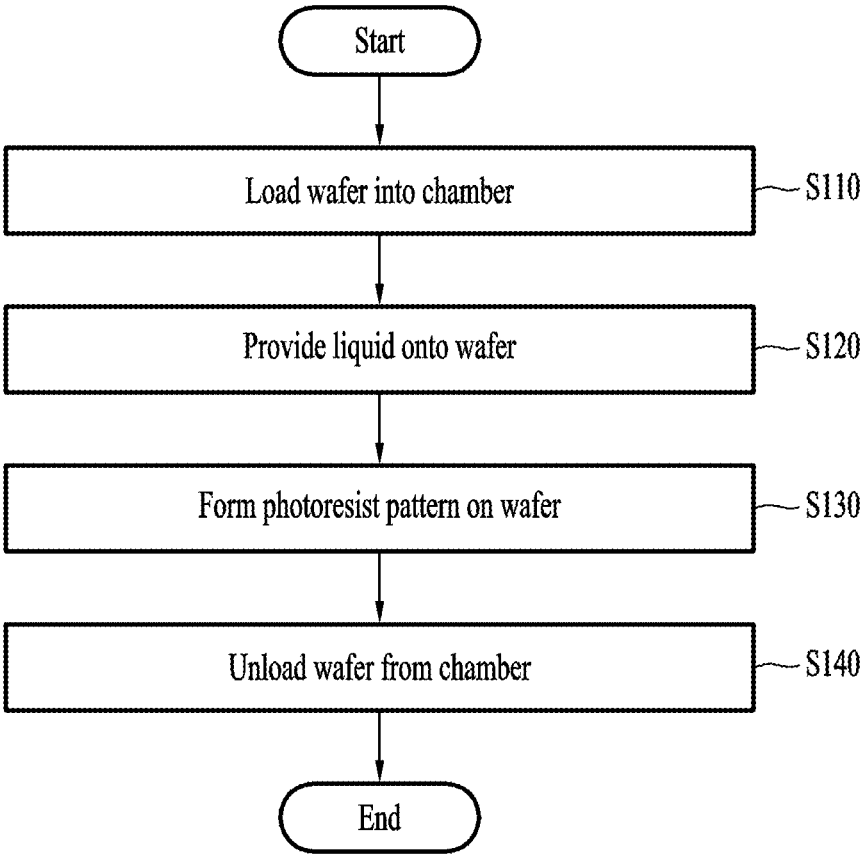
FIG. 3 is a flowchart illustrating a method of manufacturing a semiconductor device using a liquid supply system according to an embodiment.

FIG. 3 is a flowchart illustrating a method of manufacturing a semiconductor device using a liquid supply system according to an embodiment.

Referring to FIG. 3, in operation S110, a wafer may be loaded into a chamber. The wafer may be loaded on a stage disposed inside the chamber.

In operation S120, a liquid may be provided on the wafer. The liquid may be provided to a nozzle installed in the chamber, through the liquid supply device. The liquid provided to the nozzle may be applied onto the wafer. For example, the liquid may be applied onto the wafer that rotates. According to an embodiment, in operation S120, the liquid supply device may assist in minimizing an amount of particles in the liquid applied onto the wafer.

In operation S130, a photoresist pattern may be formed on the wafer. For example, a bake process may be performed on the wafer on which the liquid is applied, to change a state of the applied liquid. Subsequently, an exposure process and a development process may be performed, to form the photoresist pattern on the wafer.

In operation S140, the wafer with the formed photoresist pattern may be unloaded from the chamber.

Figure 4:
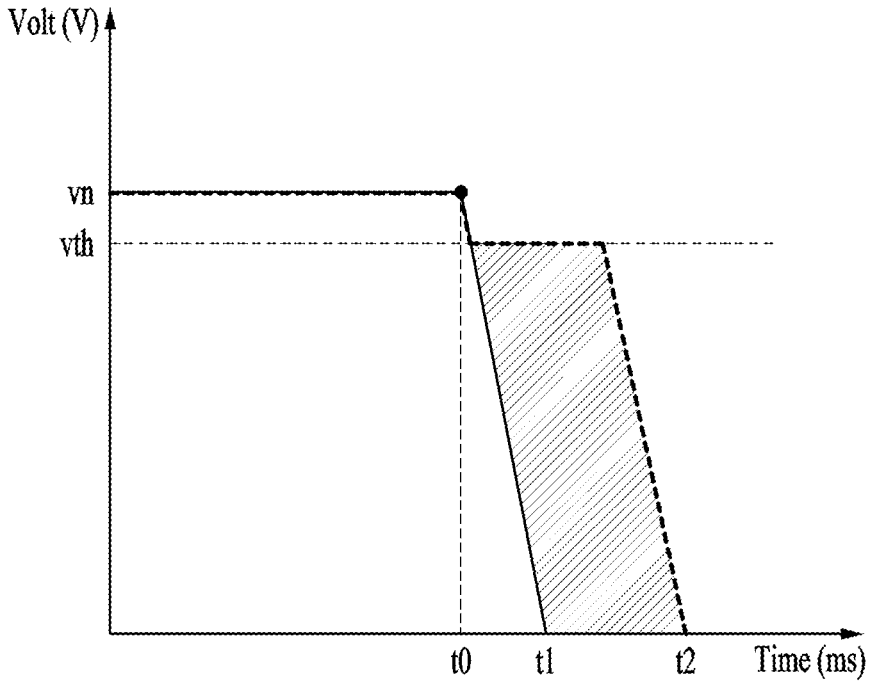
FIG. 4 is a graph schematically illustrating a voltage profile curve when a power source of a liquid supply device is shut down according to an embodiment.

FIG. 4 is a graph schematically illustrating a voltage profile curve when a power source of a liquid supply device is shut down according to an embodiment.

Referring to FIG. 4, a voltage supplied from a main power source to a pump may be a first voltage vn, and a voltage supplied from an auxiliary power source to the pump may be a second voltage vth. The magnitude of the second voltage vth may be less than the magnitude of the first voltage vn. When the main power source is shut down, a voltage may be supplied from the auxiliary power source to the pump.

In an example in which the main power source is shut down at t0, when the auxiliary power source is absent, an impeller may be stopped at t1. In another example, when an auxiliary power source is present as in the liquid supply device according to an embodiment, the impeller may be stopped at t2 even when the main power source is shut down. The impeller may be slowly decelerated. For example, when the main power source is shut down, a controller may decelerate the impeller to 0 rpm. When the decelerated impeller is stopped, the impeller may contact a case with a small amount of impact.

For example, when the main power source is shut down in a state in which the impeller is rotating at 1,000 rpm, about 100 milliseconds (ms) may be used to decelerate the impeller to 0 rpm by the auxiliary power source. In another example, when the main power source is shut down in a state in which the impeller is rotating at 3,000 rpm, about 160 ms may be used to decelerate the impeller to 0 rpm by the auxiliary power source. In another example, when the main power source is shut down in a state in which the impeller is rotating at 5,000 rpm, about 240 ms may be used to decelerate the impeller to 0 rpm by the auxiliary power source. In another example, when the main power source is shut down in a state in which the impeller is rotating at 10,000 rpm, about 500 ms may be used to decelerate the impeller to 0 rpm by the auxiliary power source.

Figure 5:
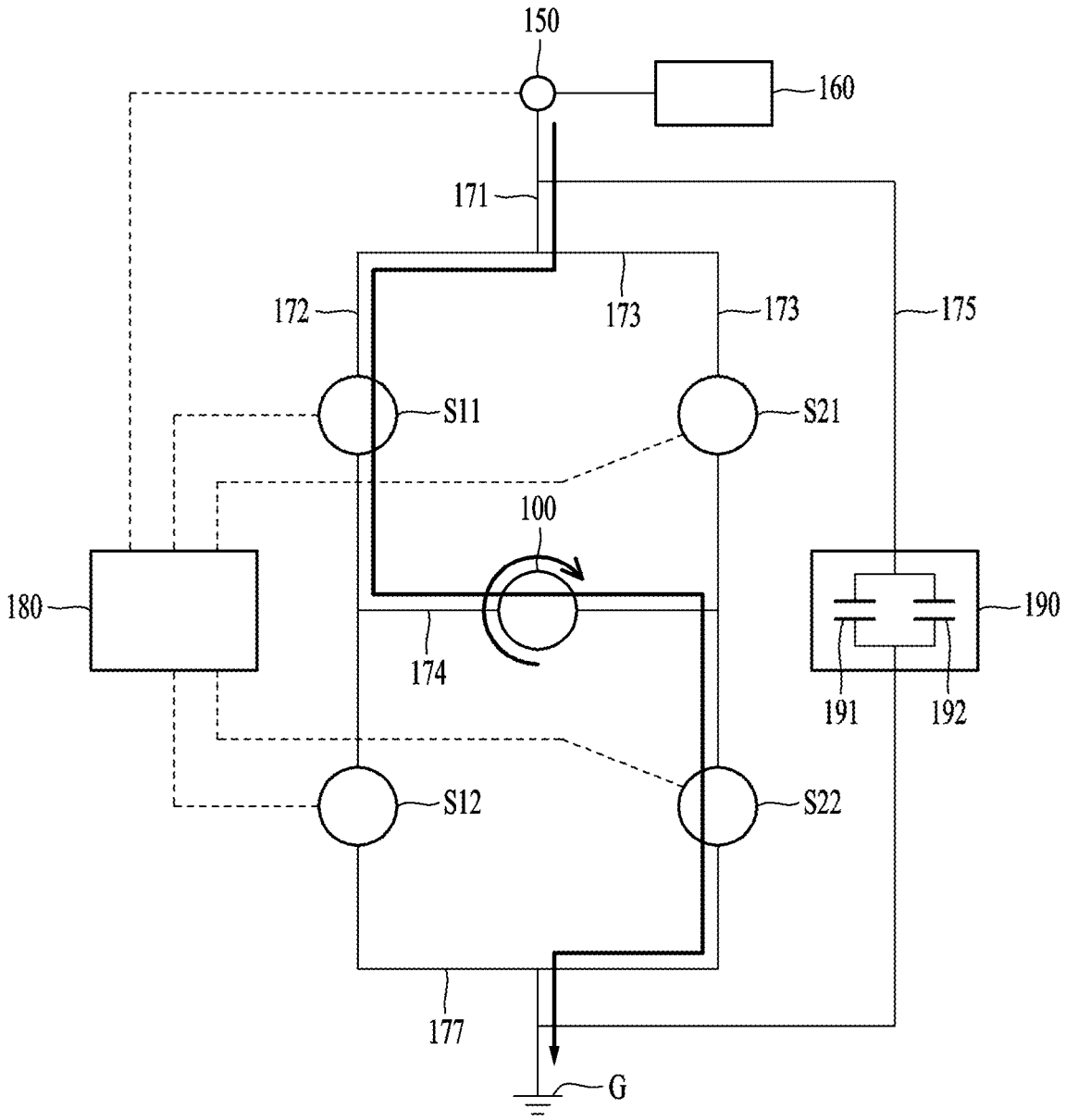
FIG. 5 is a diagram schematically illustrating a liquid supply device according to an embodiment.
Figure 6:
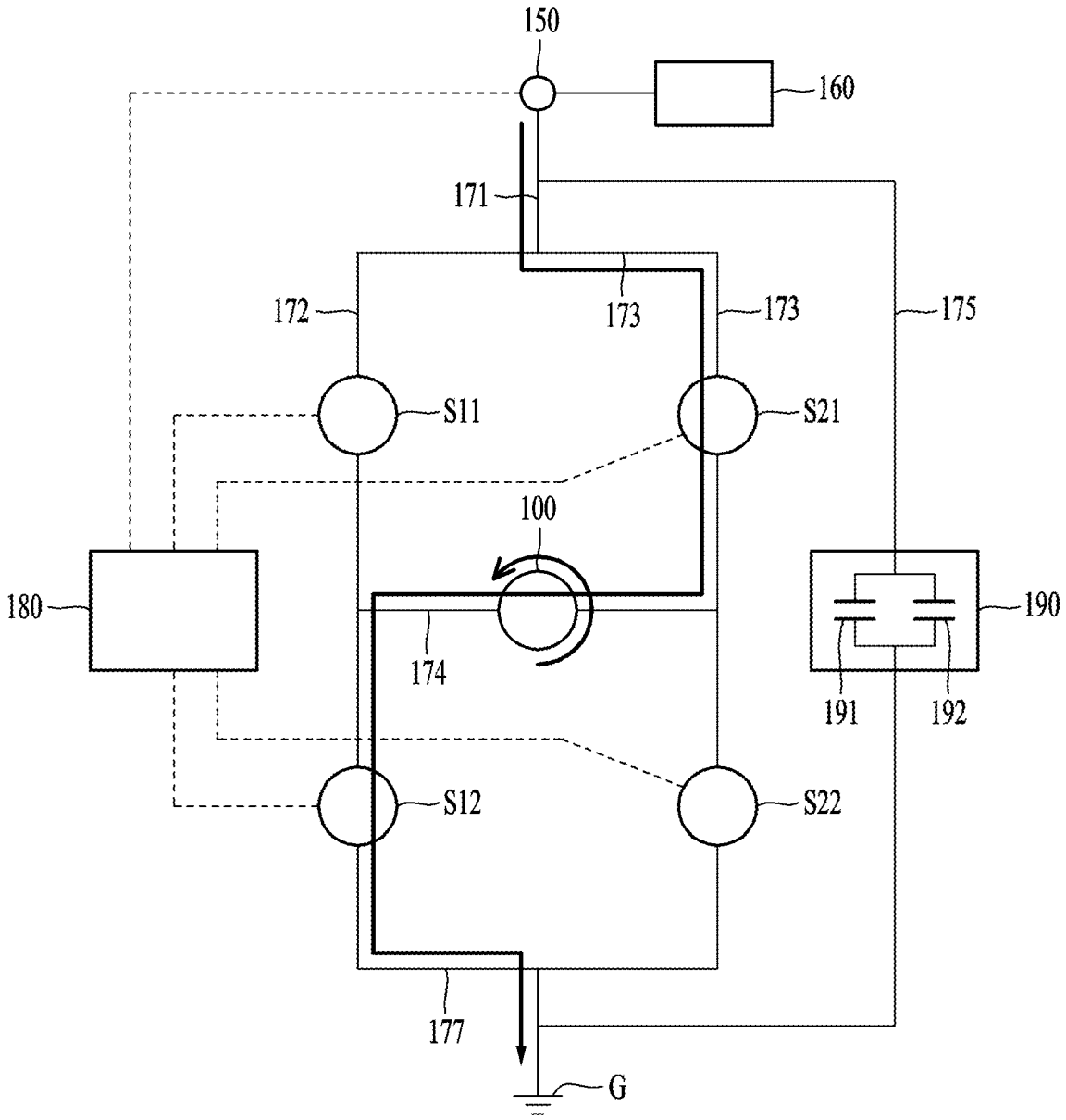
FIG. 6 is a diagram schematically illustrating a liquid supply device according to an embodiment.

FIG. 5 is a diagram schematically illustrating a liquid supply device according to an embodiment. FIG. 6 is a diagram schematically illustrating a liquid supply device according to an embodiment.

Referring to FIGS. 5 and 6, the liquid supply device may include a main power source 150, a power source sensor 160, a first line 171, a second line 172, a third line 173, a pair of first switches S11 and S12, a pair of second switches S21 and S22, a fourth line 174, a pump 100, an auxiliary power source 190, a fifth line 175, and a sixth line 177.

The main power source 150, and the auxiliary power source 190 may supply power to the pump 100. The power source sensor 160 may determine whether the main power source 150 operates normally. The power source sensor 160 may transmit information indicating whether the main power source 150 operates normally to a controller 180. The controller 180 may control a direction and an intensity of current supplied to the pump 100.

The first line 171 may be connected to the main power source 150.

The second line 172 may extend from the first line 171.

The third line 173 may extend from the first line 171. The third line 173 may extend in a direction different from a direction in which the second line 172 extends.

The pair of first switches S11 and S12 may be disposed on the second line 172. The pair of first switches S11 and S12 may include a (1-1)-th switch S11 and a (1-2)-th switch S12. The pair of first switches S11 and S12 may be turned on or off by the controller 180.

The pair of second switches S21 and S22 may be disposed on the third line 173. The pair of second switches S21 and S22 may include a (2-1)-th switch S21 and a (2-2)-th switch S22. The pair of second switches S21 and S22 may be turned on or off by the controller 180.

The fourth line 174 may connect the second line 172 and the third line 173. One end of the fourth line 174 may be disposed between the pair of first switches S11 and S12 and another end of the fourth line 174 may be disposed between the pair of second switches S21 and S22.

The controller 180 may turn on the (1-1)-th switch S11 and the (2-2)-th switch S22 and turn off the (1-2)-th switch S12 and the (2-1)-th switch S21, as shown in FIG. 5. The controller 180 may turn off the (1-1)-th switch S11 and the (2-2)-th switch S22 and turn on the (1-2)-th switch S12 and the (2-1)-th switch S21, as shown in FIG. 6. The controller 180 may control an on and off period of a switch.

The controller 180 may control a plurality of switches based on a power supplied from the main power source 150. For example, when the main power source 150 is shut down, the controller 180 may control the plurality of switches based on a power supplied from the auxiliary power source 190.

The fifth line 175 may connect the first line 171 and the sixth line 177.

The sixth line 177 may be connected to the (1-2)-th switch S12 and the (2-2)-th switch S22. The sixth line 177 may be connected to a ground G.

The auxiliary power source 190 may be connected to the fifth line 175. For example, the auxiliary power source 190 may include a capacitor. The auxiliary power source 190 may be connected to the first line 171 via the fifth line 175. The auxiliary power source 190 may include a plurality of capacitors 191 and 192 connected in parallel to the first line 171. The plurality of capacitors 191 and 192 may include a first capacitor 191 and a second capacitor 192. Although two capacitors are illustrated, the number of capacitors is not limited thereto.

Figure 7:
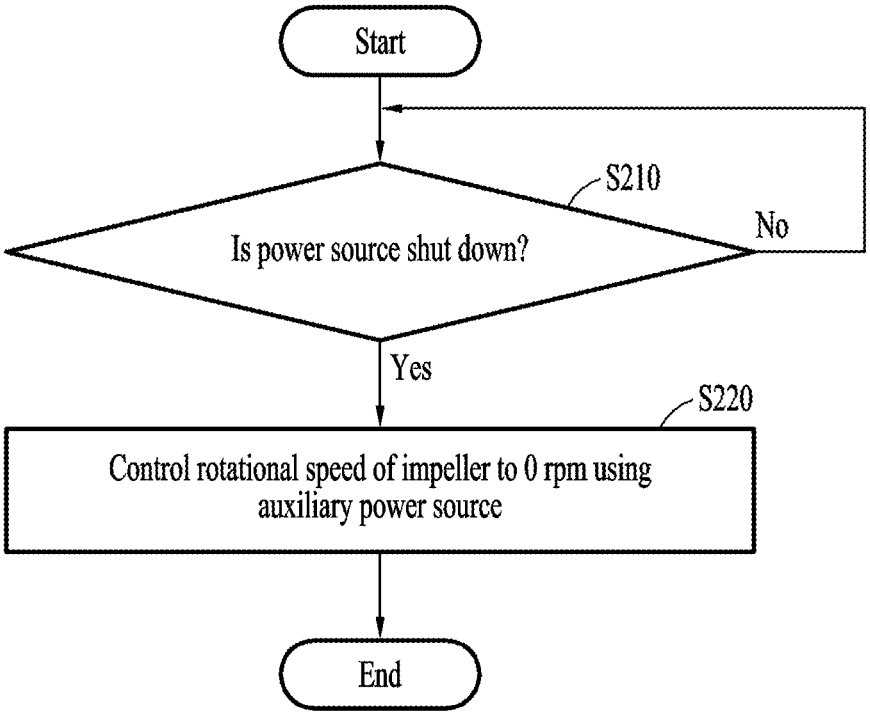
FIG. 7 is a flowchart illustrating a method of reducing a generation of particles in a liquid supply device according to an embodiment.

FIG. 7 is a flowchart illustrating a method of reducing a generation of particles in a liquid supply device according to an embodiment.

Referring to FIG. 7, in operation S210, a controller may detect a shutdown of a power source. In operation S220, the controller may control a rotational speed of an impeller to 0 rpm using an auxiliary power source. The impeller may be slowly decelerated, and may contact a case in a state in which the rotational speed of the impeller reaches "0."

Figure 8:
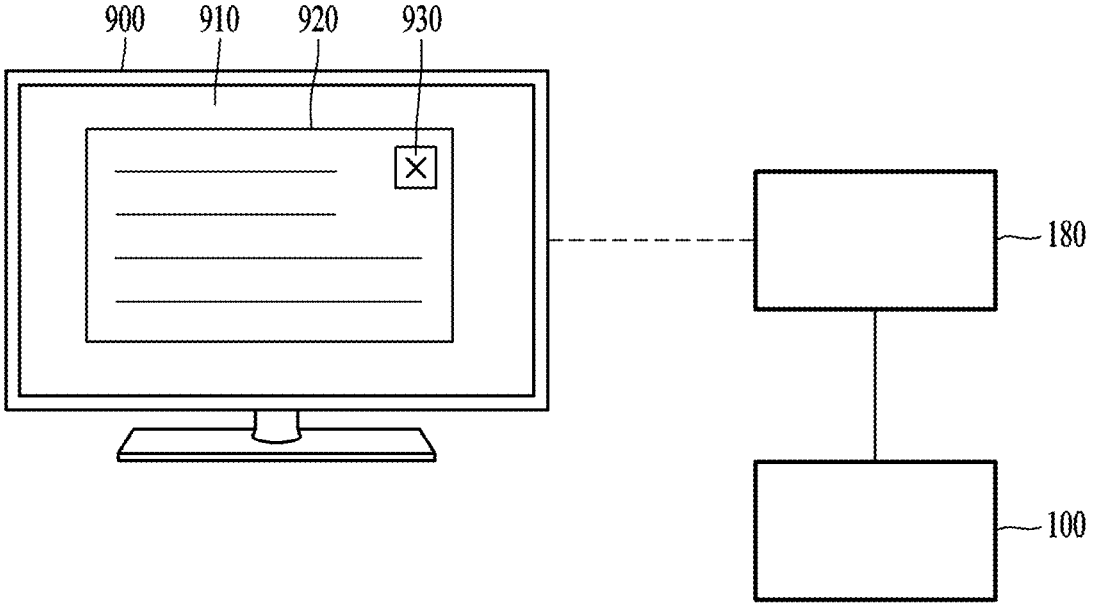
FIG. 8 is a diagram schematically illustrating an interface, a controller, and a pump according to an embodiment.
Figure 9:
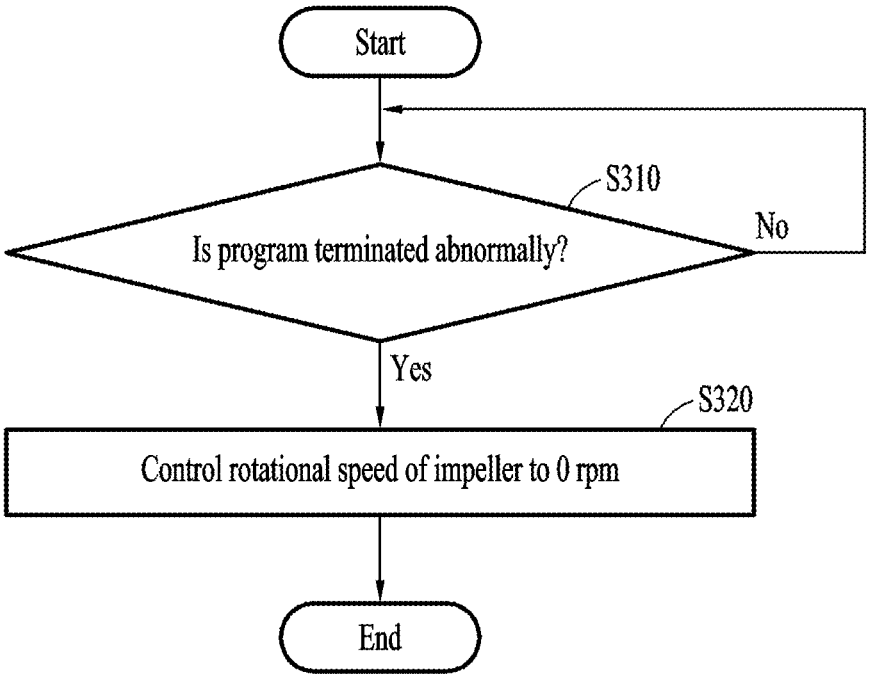
FIG. 9 is a flowchart illustrating a method of reducing a generation of particles in a liquid supply device according to an embodiment.

FIG. 8 is a diagram schematically illustrating an interface, a controller, and a pump according to an embodiment. FIG. 9 is a flowchart illustrating a method of reducing a generation of particles in a liquid supply device according to an embodiment.

Referring to FIGS. 8 and 9, the liquid supply device may include a pump 100, a controller 180, and an interface or display 900. The display 900 may be configured to operate the controller 180. A user may exchange a signal with the controller 180 using the display 900.

The display 900 may have a screen 910 that is configured to display various types of information, such as a software program 920 displayed as a graphical user interface (GUI) within the screen 910. The software program 920 is configured to control operations of the liquid supply device. The displayed GUI of the software program 920 may include a GUI control 930 that is configured to terminate the software program 920 and close the GUI. When the software program 920 displayed within the screen 910 is terminated (e.g., by clicking on or otherwise activating the GUI control 930), the controller 180 may reduce a rotational speed of an impeller. For example, when the software program 920 displayed within the screen 910 is terminated by closing the GUI of the software program 920, the controller 180 may control the rotational speed of the impeller to 0 rpm.

In operation S310, the controller may detect an abnormal termination of the software program 920. In operation S320, the controller may control the rotational speed of the impeller to 0 rpm using the auxiliary power source. The impeller may be slowly decelerated, and may contact a case in a state in which the rotational speed of the impeller reaches "0." When the software program 920 displayed within the screen 910 is terminated, the controller may selectively reduce the rotational speed of the impeller. For example, when the software program 920 is terminated, the controller may operate the impeller at a constant speed or feedback operate the impeller according to a last command. In an example, when the software program 920 is terminated, the controller may decelerate the impeller to 0 rpm and turn off a power source. In another example, the controller may continue to maintain the rotational speed of the impeller, even when the software program 920 is terminated.

While the embodiments are described with reference to drawings, it will be apparent to one of ordinary skill in the art that various alterations and modifications in form and details may be made in these embodiments without departing from the scope of the claims and their equivalents. For example, suitable results may be achieved if the described techniques are performed in a different order and/or if components in a described system, architecture, device, or circuit are combined in a different manner and/or replaced or supplemented by other components or their equivalents.

Therefore, other implementations, other embodiments, and equivalents to the claims are also within the scope of the following claims.

What is claimed is:

1. A liquid supply device that reduces particle generation, the liquid supply device comprising:

a pump configured to supply a liquid to a nozzle within a wafer processing chamber;

a controller configured to control the pump; and a main power source configured to supply electrical power to the pump, wherein the pump comprises a stator, a coil surrounding the stator, a case having an internal space, and an impeller within the internal space, wherein the impeller is rotated by a magnetic force generated by the stator and the coil, and wherein, when the electrical power is shut off from the main power source to the coil, the controller is configured to reduce a rotational speed of the impeller and stop the pump, wherein the pump is a magnetic levitation-type pump configured to rotate the impeller in a non-contact manner by the magnetic force, wherein at least a portion of the impeller contacts the case when the impeller is at rest, and wherein the impeller comprises:

an impeller body:

a permanent magnet inside the impeller body; and an impeller arm that protrudes from the impeller body in a direction perpendicular to a rotation axis of the impeller body, and wherein the impeller arm contacts the case when the impeller is at rest.

2. The liquid supply device of claim 1, further comprising:

an auxiliary power source configured to supply auxiliary electrical power to the pump.

3. The liquid supply device of claim 2, wherein, when the electrical power from the main power source is shut off, the controller is configured to control the pump using the auxiliary electrical power from the auxiliary power source.

4. The liquid supply device of claim 2, wherein a magnitude of a voltage of the auxiliary electrical power from the auxiliary power source to the pump is less than a magnitude of a voltage of the electrical power from the main power source to the pump.

5. The liquid supply device of claim 2, wherein, when the auxiliary electrical power is supplied from the auxiliary power source to the pump, the controller is configured to decrease the rotational speed of the impeller.

6. The liquid supply device of claim 2, further comprising:

a first power source line connected to the main power source;

a second power source line extending from the first power source line;

a pair of first switches connected to the second power source line;

a third power source line extending from the first power source line;

a pair of second switches connected to the third power source line; and a fourth power source line configured to connect the second power source line and the third power source line, wherein one end of the fourth power source line is between the pair of first switches, an opposite end of the fourth power source line is between the pair of second switches, and the fourth power source line is connected to the pump, wherein the controller is configured to control on and off of the pair of first switches and the pair of second switches.

7. The liquid supply device of claim 6, wherein the auxiliary power source is connected to the first power source line.

8. The liquid supply device of claim 6, wherein the auxiliary power source comprises at least one capacitor.

9. The liquid supply device of claim 8, wherein the auxiliary power source comprises a plurality of capacitors connected in parallel to the first power source line.

10. The liquid supply device of claim 1, further comprising:

an interface configured to provide operational control of the controller to a user.

11. The liquid supply device of claim 10, wherein the interface comprises a screen that is configured to display a graphical user interface (GUI) associated with a software program that is configured to control operations of the liquid supply device, and wherein, when the software program GUI displayed within the screen is closed, the controller is configured to selectively reduce the rotational speed of the impeller.

12. The liquid supply device of claim 11, wherein, when the software program GUI is closed, the electrical power supplied from the main power source to the pump decreases.

13. A liquid supply device that reduces particle generation, the liquid supply device comprising:

a pump configured to supply a liquid to a nozzle within a wafer processing chamber;

a controller configured to control the pump;

a main power source configured to supply electrical power to the pump; and an auxiliary power source configured to supply auxiliary electrical power to the pump, wherein the auxiliary power source is spaced apart from the main power source, wherein the pump comprises a stator, a coil surrounding the stator, a case having an internal space, and an impeller within the internal space, wherein the impeller is rotated by a magnetic force generated by the stator and the coil, and wherein, when the electrical power is shut off from the main power source to the coil, the controller is configured to control the auxiliary power source to supply the auxiliary electrical power to the pump to reduce a rotational speed of the impeller and stop the pump, wherein the pump is a magnetic levitation-type pump configured to rotate the impeller in a non-contact manner by the magnetic force, wherein at least a portion of the impeller contacts the case when the impeller is at rest, and wherein the impeller comprises:

an impeller body:

a permanent magnet inside the impeller body; and an impeller arm that protrudes from the impeller body in a direction perpendicular to a rotation axis of the impeller body, and wherein the impeller arm contacts the case when the impeller is at rest.

14. The liquid supply device of claim 13, wherein a magnitude of a voltage of the auxiliary electrical power supplied by the auxiliary power source to the pump is less than a magnitude of a voltage of the electrical power supplied by the main power source to the pump.

15. The liquid supply device of claim 14, further comprising:

a first power source line connected to the main power source and the auxiliary power source;

a second power source line extending from the first power source line;

a pair of first switches connected to the second power source line;

a third power source line extending from the first power source line;

a pair of second switches connected to the third power source line; and a fourth power source line configured to connect the second power source line and the third power source line, wherein one end of the fourth power source line is between the pair of first switches, an opposite end of the fourth power source line is between the pair of second switches, and the fourth power source line is connected to the pump, wherein the controller is configured to control on and off of the pair of first switches and the pair of second switches.

16. A liquid supply device that reduces particle generation, the liquid supply device comprising:

a pump configured to supply a liquid to a nozzle within a wafer processing chamber;

a controller configured to control the pump;

a main power source configured to supply electrical power to the pump; and an interface configured to provide operational control of the controller to a user, wherein the pump comprises a stator, a coil surrounding the stator, a case having an internal space, and an impeller within the internal space, wherein the impeller is rotated by a magnetic force generated by the stator and the coil, and wherein, when the electrical power is shut off from the main power source to the coil, the controller is configured to reduce a rotational speed of the impeller and stop the pump, wherein the pump is a magnetic levitation-type pump configured to rotate the impeller in a non-contact manner by the magnetic force, wherein at least a portion of the impeller contacts the case when the impeller is at rest, and wherein the impeller comprises:

an impeller body:

a permanent magnet inside the impeller body; and an impeller arm that protrudes from the impeller body in a direction perpendicular to a rotation axis of the impeller body, and wherein the impeller arm contacts the case when the impeller is at rest.

17. The liquid supply device of claim 16, wherein the interface comprises a screen that is configured to display a graphical user interface (GUI) associated with a software program that is configured to control operations of the liquid supply device, and wherein, when the software program GUI displayed within the screen is closed, the controller is configured to selectively reduce the rotational speed of the impeller.

* * * * *